US005873237A

United States Patent [19]

Medla et al.

[11] Patent Number: 5,873,237

[45] Date of Patent: Feb. 23, 1999

[54] ATOMIZING DUAL FUEL NOZZLE FOR A COMBUSTION TURBINE

[75] Inventors: Andrew Alan Medla, Oviedo; John Stephen Dontrich, Lake Mary, both of Fla.

[73] Assignee: Westinghouse Electric Corporation, Pittsburgh, Pa.

[21] Appl. No.: 789,215

[22] Filed: Jan. 24, 1997

[51] Int. Cl.[6] ..... F02C 7/22

[52] U.S. Cl. ..... 60/39.32; 60/740

[58] Field of Search ..... 60/39.31, 39.32, 60/39.463, 740, 742, 746

[56] References Cited

U.S. PATENT DOCUMENTS

| | | | |
|---|---|---|---|
| 3,608,831 | 9/1971 | Place et al. | 239/406 |
| 3,719,326 | 3/1973 | Place et al. | 239/406 |
| 3,886,736 | 6/1975 | Kawaguchi | 60/39.74 |
| 4,154,056 | 5/1979 | Emory . | |
| 4,850,196 | 7/1989 | Scalzo et al. | 60/740 |
| 4,891,935 | 1/1990 | McLaurin et al. | 60/39.37 |
| 5,222,357 | 6/1993 | Eddy et al. . | |
| 5,259,184 | 11/1993 | Borkowicz et al. | 60/742 |
| 5,408,830 | 4/1995 | Lovett | 60/742 |

FOREIGN PATENT DOCUMENTS

| | | |
|---|---|---|
| 0191634 | 8/1986 | European Pat. Off. . |
| 7340018 | 7/1974 | France . |

*Primary Examiner*—Louis J. Casaregola
*Attorney, Agent, or Firm*—Daniel C. Abeles; Eckert Seamans Cherin & Mellott, LLC

[57] ABSTRACT

A dual fuel nozzle for a combustion turbine having a swirl cap that is adapted to securely mount with an atomizing cylinder proximate its discharge end. A nozzle tip that is adapted to removably mount with a liquid fuel pipe is provided. The atomizing cylinder comprises an outer wall having an inlet end and opposing discharge end, and flange portion formed proximate the inlet end. The flange portion is adapted to be securely coupled with the liquid fuel pipe to the combustion turbine. The outer wall and flange portion define a receptacle that extends from the inlet end and substantially downstream to the discharge end. The receptacle is adapted to removably receive the liquid fuel pipe and the nozzle tip. The liquid fuel pipe has an inlet end and discharge end with the discharge end adapted to removably receive the nozzle tip. The liquid fuel pipe defines a liquid fuel flow passage that extends from the inlet end and substantially downstream of the flange portion proximate the discharge end. The flange portion further defines an atomizing air supply channel. The liquid fuel pipe and nozzle tip are removably positioned within the receptacle of the atomizing air cylinder. An atomizing airflow passage is defined between the air cylinder and the liquid fuel pipe such that the airflow passage is in fluid communication with the atomizing air supply channel at one end and the swirl cap proximate the other end.

4 Claims, 5 Drawing Sheets

ATOMIZING DUAL FUEL NOZZLE FOR A COMBUSTION TURBINE

FIELD OF THE INVENTION

The present invention relates to dual fuel nozzles for gas turbines, and more particularly to a dual fuel nozzle that utilizes high-temperature atomizing air.

BACKGROUND OF THE INVENTION

Dual fuel nozzles employed in the combustion section of a gas turbine are well known in the art. Dual fuel nozzles are employed to atomize a liquid fuel to enable a gas turbine to operate more effectively and improve the start-up reliability of the combustion turbine. The atomization of a liquid fuel consists of breaking down the liquid fuel into fine particles to form a spray that can be combusted after the mixture is ejected out through the nozzle.

In a dual fuel nozzle, high-temperature atomizing air is used in conjunction with the flow of a liquid fuel to start up the combustor. The liquid fuel is ejected through a nozzle as an atomizing air flow is directed at, and strikes, the liquid fuel at a relatively high-temperature and high-pressure. When the atomizing air impacts the liquid fuel, the liquid fuel is broken down into relatively smaller particles to form a combustible spray which is easily combusted in the combustor section of the gas turbine.

A conventional dual fuel nozzle assembly 20 coupled to a gas turbine 22 is shown in FIG. 1. The conventional dual fuel nozzle assembly generally comprises a main nozzle body 24, spacer collar 26, and unitary atomizing air and liquid fuel member 28. The main nozzle body 24 and unitary atomizing air and liquid fuel delivery member 28 are coupled together with the spacer collar 26 therebetween.

The main nozzle body portion 24 comprises a flange portion 30 and a gas supply portion 32. The flange portion 30 is adapted to be mounted to the gas turbine 22. The main nozzle body portion 24 defines a centrally disposed bore 34 that extends from the flange portion 30 and through the gas supply portion 32 for receiving the unitary atomizing air and liquid fuel member 28.

Referring to FIG. 2, the prior art unitary atomizing air and liquid fuel member 28 is shown in more detail. The unitary atomizing air and liquid fuel member 28 has a inlet end 36 and discharge end 38. The unitary atomizing air and liquid fuel delivery member 28 comprises a nozzle flange portion 40, outer wall 42, inner wall 44, liquid fuel pipe 46, nozzle tip 48, lap joint 50, and swirl cap 52. The nozzle flange portion 40 further defines an atomizing air supply channel 54.

The unitary atomizing air and liquid fuel member outer wall 42 is concentrically disposed about the inner wall 44. The outer wall 42 is spaced apart from the inner wall 44, thereby, defining an atomizing air flow passage 56 which is in fluid communication with the atomizing air supply passage 54. A conical end portion 60 of the outer wall 42 proximate to the discharge end 38 is adapted to securely receive the swirl cap 52.

The inner wall 44 defines a bore 62 for receiving the liquid fuel pipe 46. A portion of the inner wall 44 proximate to the discharge end 38 is adapted to securely receive the nozzle tip 48. The nozzle tip 48 is seated adjacent to the swirl cap 52, with the lap joint 50 therebetween.

When a turbine starts-up on a relatively heavy fuel, combustion air having a temperature of approximately 100° F. surrounds the outer wall 42 of the unitary atomizing air and liquid fuel delivery member 28. The inner wall 44 of the air and fuel delivery member 28 is subjected to a flow of liquid fuel having a temperature of about 200° F. The differences between these temperatures may cause the nozzle tip 48 to expand axially into the lap joint 50 and swirl cap 52, and over the axial extent of the tube, results in the loss of the lap joint 50 and damage to the swirl cap 52.

It would therefore, be desirable to provide a nozzle assembly that provides improved integrity.

Because unitary atomizing air and liquid fuel supply member 28 employed in dual fuel nozzle assemblies 20 cannot be disassembled, neither the nozzle tip 48 nor swirl cap 52 can be replaced or repaired when necessary. It would, therefore, be desirable to provide a dual fuel nozzle that can be repaired.

Another problem that may arise during the operation of a dual fuel nozzle 20 is that the nozzle tip 48 may become clogged when a residuum of liquid fuel remains in the nozzle tip or liquid fuel passage 58 and is subjected to long periods of heat soaking. As the residuum is exposed to heat over a certain period of time, the residuum forms deposits of gums, carbon, and varnish. These deposits end up clogging the orifices in the nozzle tip 48, thereby, constricting the fluid flow through the nozzle tip 48. Once the fluid flow is constricted, however, the nozzle tip 48 cannot be replaced or repaired because the unitary atomizing air and liquid fuel delivery member 28 cannot be disassembled to gain access to the constricted area.

It would, therefore, be desirable to provide a dual fuel nozzle that is relatively easy to maintain.

SUMMARY OF THE INVENTION

An atomizing dual fuel nozzle for a combustion turbine is provided. The dual fuel nozzle comprises a swirl cap that is adapted to securely mount with an atomizing cylinder. A nozzle tip adapted to removably mount with a liquid fuel pipe is provided.

An independent atomizing cylinder is provided. The atomizing cylinder further comprises an outer wall having an inlet end and opposing discharge end, and flange portion formed proximate the inlet end. The flange portion is adapted to securely couple with a liquid fuel pipe to the combustion turbine. The outer wall and flange portion define a receptacle extending from the inlet end and substantially downstream to the discharge end. The receptacle is adapted to removably receive a liquid fuel pipe and the nozzle tip. The swirl cap is securely mounted proximate the air cylinder discharge end.

An independent liquid fuel pipe having an inlet end and discharge end is provided. The discharge end is adapted to removably receive the nozzle tip. The liquid fuel pipe comprises an outer surface and flange portion proximate the inlet end. The outer surface and flange portion define a liquid fuel flow passage extending from the inlet end and substantially downstream of the flange portion proximate the discharge end. The nozzle tip is removably mounted substantially downstream of the flange portion proximate the discharge end. The flange portion further defines an atomizing air supply channel.

The independent liquid fuel pipe and nozzle tip are removably positioned within the receptacle of the independent atomizing air cylinder and define an atomizing airflow passage between the air cylinder outer wall and the outer surface of the liquid fuel pipe such that the airflow passage is in fluid communication with the atomizing air supply channel defined by said liquid fuel pipe flange portion.

DETAILED DESCRIPTION OF THE PREFERRED EMBODIMENTS

Figure 1:
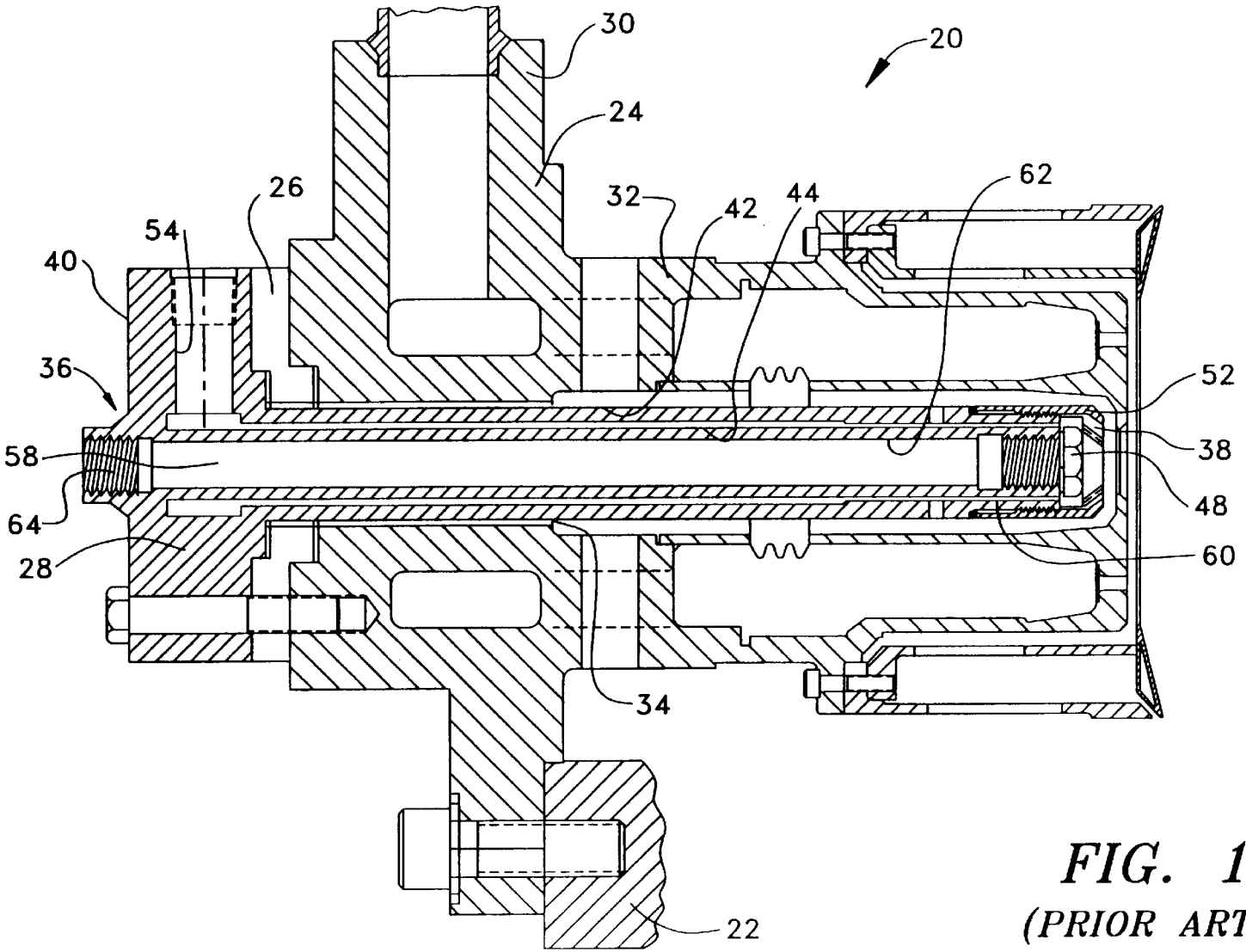
FIG. 1 (PRIOR ART)
FIG. 1 is a cross-sectional view of a prior art dual fuel nozzle mounted in a combustion gas turbine.
Figure 2:
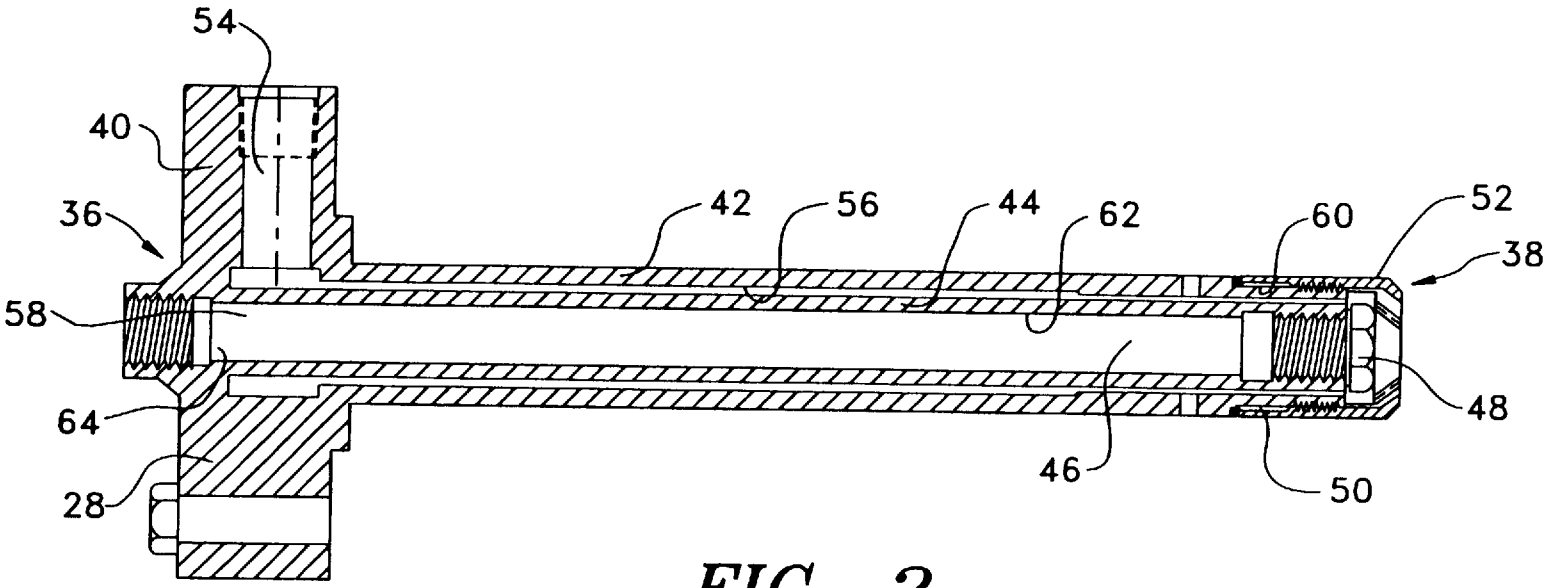
FIG. 2 (PRIOR ART)
FIG. 2 is a cross-sectional view of the prior art dual fuel nozzle shown in FIG. 1.
Figure 3:
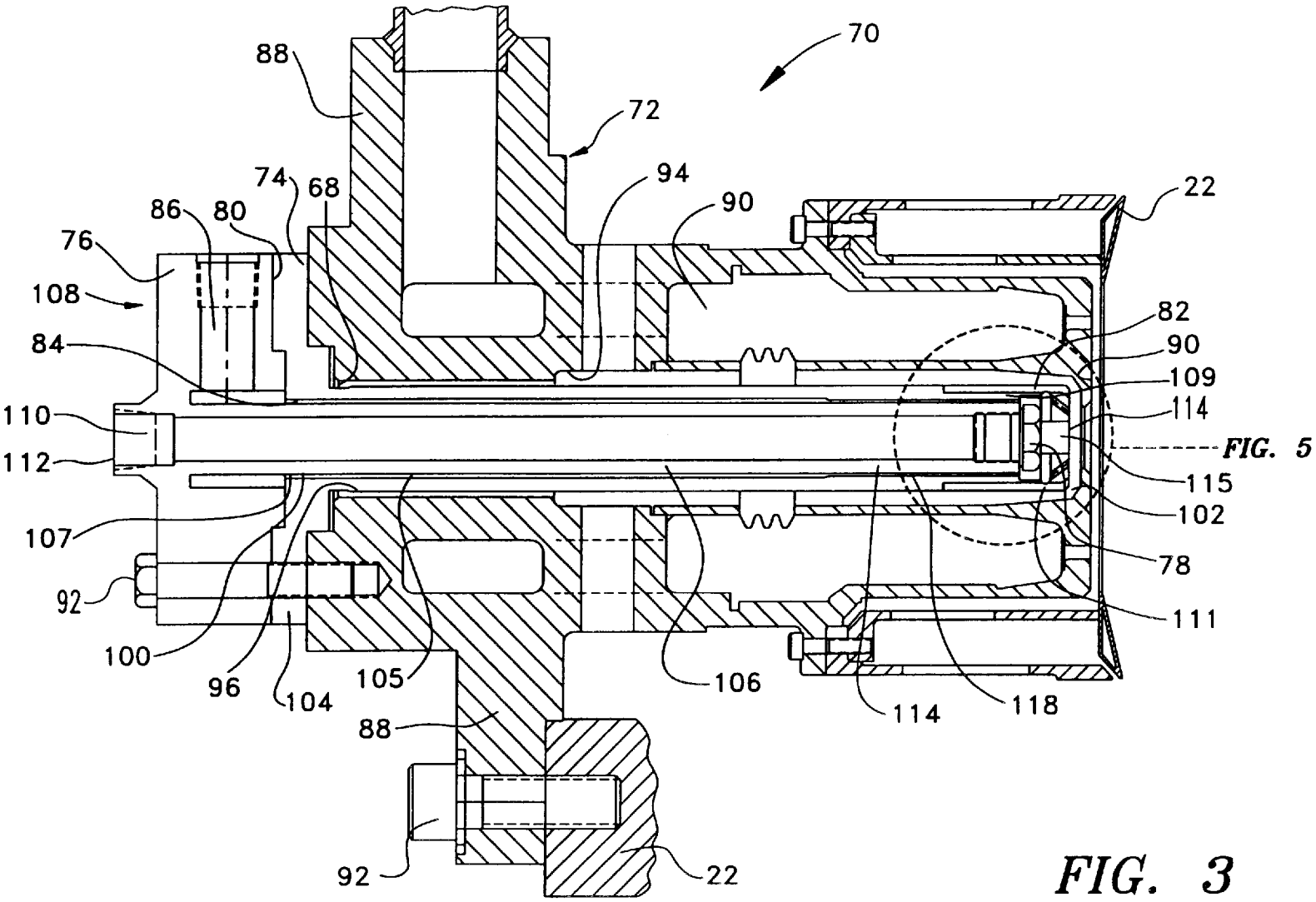
FIG. 3 is a cross-sectional view of a preferred embodiment of a dual fuel nozzle in accordance with the present invention mounted in a combustion turbine.

Referring to FIG. 3, a cross sectional view of a dual fuel nozzle assembly 70 in accordance with the present invention is shown in communication with a combustor of a combustion turbine 22. The fuel nozzle assembly 70 comprises a main body portion 72, an independent atomizing air cylinder 74, an independent liquid fuel pipe 76, a nozzle tip 78, seals 80, and a swirl cap 82. The atomizing air cylinder 74 and liquid fuel pipe 76 are removably coupled to each other to form an atomizing air flow passage 84 therebetween. Seals 80 are positioned between the atomizing air cylinder 74 and liquid fuel pipe 76 to prevent contaminants and/or gases from flowing passed the same. Preferably, the seals 80 are made of a permatex compound. An air supply channel 86 is in fluid communication with the atomizing air flow passage 84 to supply the atomizing air. A liquid or oil fuel supply assembly (not shown) is in fluid communication with the liquid fuel pipe 76.

The main body portion 72 comprises a flange portion 88, and gaseous fuel supply assembly 90. The flange portion 88 is adapted to be securely mounted to the combustion turbine 22 with fastening members 92, such as bolts. The gaseous fuel supply assembly 90 is provided for supplying gaseous fuel to the combustor 22. The main body portion 72 defines a centrally disposed bore 94 that extends from the flange portion 88 and through the gaseous supply assembly 90. The main body bore 94 has an inlet end 68 and an opposing discharge end 98. The bore 94 is adapted to receive the atomizing air cylinder 74, liquid fuel pipe 76, nozzle tip 78, and swirl cap 82. Preferably, the bore 94 is adapted to concentrically receive these components.

The atomizing air cylinder 74 comprises an outer wall 96 having an inlet end 100 and opposing discharge end 102. A flange portion 104 is formed proximate the inlet end 100 and adapted to be securely coupled with the liquid fuel pipe 76 to the main body portion 72. The outer wall 96 and flange portion 104 define a receptacle 105 that extends from the outer wall inlet end 100 and substantially downstream through to the discharge end 102. The receptacle 105 defines openings at both the inlet end 107 and discharge end 109. Preferably, the receptacle 105 is formed to concentrically receive the liquid fuel pipe 76 and allow the liquid fuel pipe 76 to extend passed the discharge end opening 109. The air cylinder receptacle 105 is adapted to receive the liquid fuel pipe 76 and nozzle tip 78 in a spaced apart relationship, thereby, defining the atomizing airflow passage 84.

An end portion 111 of the atomizing air cylinder outer wall 96 proximate to the discharge end of the air cylinder is adapted to securely receive the swirl cap 82. Preferably, the swirl cap 82 is welded in place. The swirl cap 82 is adapted to adjacently receive a portion of the liquid fuel pipe conical end 115 proximate to the discharge end 114 and nozzle tip 78. The atomizing air cylinder 74 and swirl cap 82 are described in more detail below.

The liquid fuel pipe 76 has an outer surface 106 and flange portion 108. The outer surface 106 and flange portion 108 define a liquid fuel flow passage 110. The liquid fuel flow passage 110 has an inlet end 112 proximate to the flange portion 108, and discharge end 114 substantially downstream of the flange portion 108. Preferably, the liquid fuel flow passage 110 is concentrically disposed through the outer surface 106 and flange portion 108. Additionally, the flange portion 108 defines the atomizing air supply channel 86 that is adapted to be in fluid communication with the atomizing air flow passage 84.

A portion of the liquid fuel pipe proximate to the discharge end 114 upstream of the conical end 115 is formed with a plurality of positioning pins 118. Preferably, there are four equidistant pins disposed radially. The positioning pins 118 are provided to position the liquid fuel pipe 76 within the atomizing cylinder receptacle 105. The conical end 115 of the liquid fuel pipe downstream of the positioning pins is adapted to removably receive the nozzle tip 78. Preferably, the conical end 115 is threaded to removably receive the nozzle tip 78. The nozzle tip 78 extends passed the atomizing air cylinder discharge end opening 109 such that the nozzle tip 78 projects adjacently proximate the swirl cap 82 conical opening 83. It is noted that those with ordinary skill in the art are knowledgeable of how nozzle tips 78 function.

Figure 4:
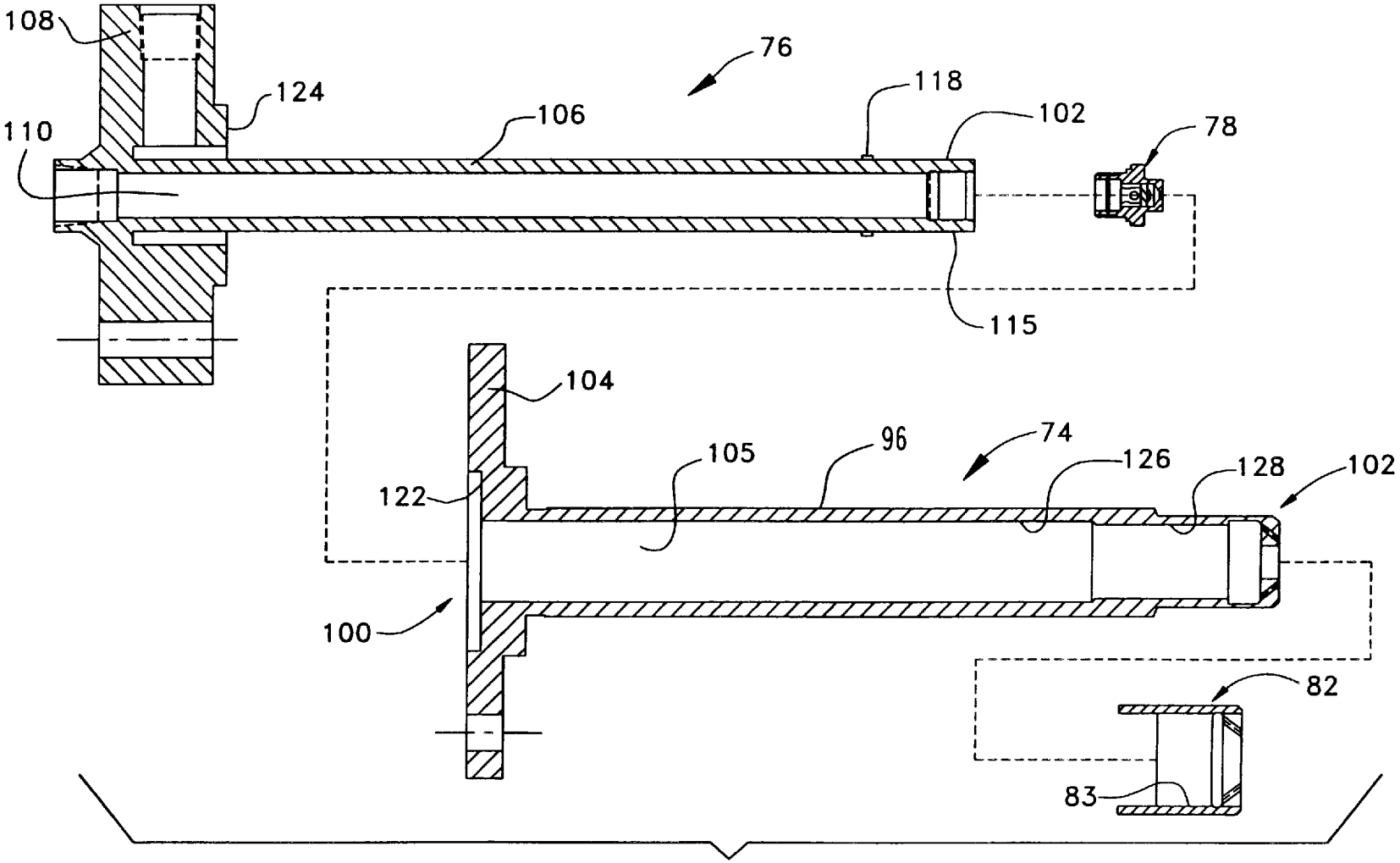
FIG. 4 is an exploded view of the dual fuel nozzle shown in FIG. 3.

Referring to FIG. 4, the atomizing cylinder 74, swirl cap 82 and liquid fuel pipe 76 are shown in more detail. The atomizing air cylinder receptacle 105 as defined by the outer wall 96 and flange portion 104 is shown extending between the inlet end 100 and discharge end 102. The atomizing cylinder inlet end 100 is formed with a stepped groove 122 that securely mates with the liquid fuel pipe protruding stepped face portion 124 when the liquid fuel pipe 76 is positioned within the atomizing cylinder receptacle 105.

Preferably, the atomizing receptacle 105 has at least one diameter that is large to enable the positioning pins 118, nozzle tip 78, and a flow of atomizing air to pass through. Preferably, the receptacle 105 comprises a plurality of concentric diameters 126, 128 of differing dimensions. More preferably, there are two concentric diameters wherein the largest diameter 126 is adapted to abuttingly receive and maintain the plurality of liquid nozzle positioning pins 118 in the desired position and permit atomizing air to flow through. The smaller of the diameters 128 is large enough to allow the nozzle tip 78 to pass through.

The liquid fuel pipe outer surface 106 and flange portion 108 define the liquid fuel flow passage 110. The atomizing air supply channel 86 defined by the flange portion 108 is shown. The protruding stepped face portion 124 is shown in more detail. The positioning pins 118 are shown located on the liquid fuel pipe outer surface 106 proximate the discharge end 102. The discharge end 102 defines the generally conical end 115 which is adapted to be positioned adjacent to the swirl cap conical opening 83.

The swirl cap 82 comprises a conical support opening 83 in which the conical end 115 of the liquid fuel pipe 76 is adjacently positioned. Atomizing discharge passages 132 are formed in the swirl cap 82 for directing the atomizing air towards the liquid fuel that is sprayed from the liquid fuel pipe 76. It is noted that those having ordinary skill in the art are knowledgeable with how swirl caps 82 function.

Figure 5:
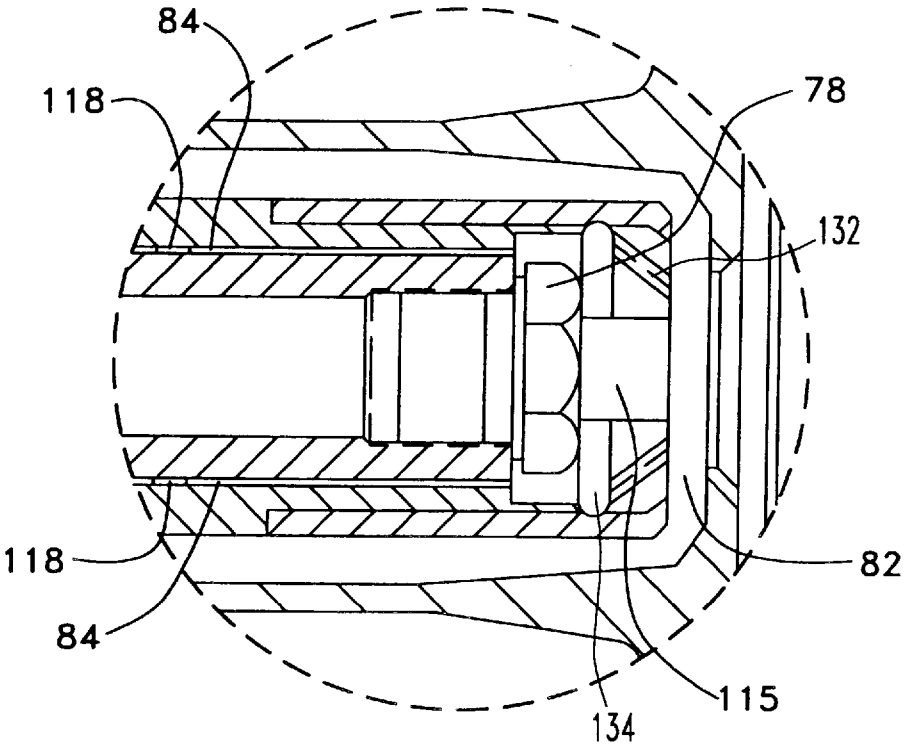
FIG. 5 is an isolated view of the dual fuel nozzle shown in FIG. 3.

Referring to FIG. 5, a more detailed view of the nozzle tip 78 and downstream conical end 115 of the liquid fuel pipe proximate to the nozzle tip 78 are shown positioned adjacent to the swirl cap 82. The swirl cap 82 and nozzle tip 78 are positioned with a expansion gap 134 therebetween in which the nozzle tip and swirl cap can expand into when exposed to heat. The gap 134 is filled by the nozzle tip and/or swirl cap without either of the two components expanding into the other.

In operation, the atomizing dual fuel nozzle assembly 70 in accordance with the present invention is adapted to be removably coupled to a combustion turbine. The atomizing air cylinder receptacle 105 removably receives the liquid fuel pipe 76 and nozzle tip 78. The liquid fuel pipe 76 is maintained in an operating location by the positioning pins 118 and fastening members 92. Additionally, the positioning pins 118 and fastening members 92 ensure that the nozzle tip 78 remains adjacent to the swirl cap 82 without contacting the swirl cap 82. The nozzle tip 78 and swirl cap are positioned with a gap 134 therebetween which provides both of these components an area in which to expand, without expanding into the other.

When it is determined that there is a fuel obstruction in the nozzle tip 78, liquid fuel flow passage 110, or swirl cap 82 discharge passages 132 the fastening members 92 are removed to enable the liquid fuel pipe 76 and nozzle tip 78 to be removed from the atomizing air cylinder receptacle 105 to clear the obstruction. The nozzle tip 78 is cleaned by first removing it from the liquid fuel pipe conical end 115 and then cleared of any obstruction therefrom. The swirl cap discharge passages 132 can also be cleared at this time.

Although the present invention has been illustrated with respect to a particular dual fuel nozzle for a combustion turbine, the invention may be utilized in other types of combustion turbines. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A dual fuel nozzle for a combustion turbine, said dual fuel nozzle comprising:

a. a main nozzle body housing a fuel gas supply channel and including a central annulus;

b. a swirl cap, said swirl cap adapted to securely mount with an atomizing cylinder removably received within the annulus of said main nozzle body;

c. a nozzle tip, said nozzle tip adapted to removably mount with a liquid fuel pipe;

d. said atomizing cylinder further comprising a tubular member having an inlet end and opposing discharge end, and flange portion formed proximate the inlet end, said flange portion adapted to securely couple with said liquid fuel pipe to the combustion turbine, said tubular member and flange portion defining a receptacle extending from the inlet end and substantially downstream to the discharge end, said receptacle adapted to removably receive said liquid fuel pipe and said nozzle tip, said swirl cap securely mounted proximate said air cylinder discharge end;

e. said liquid fuel pipe further comprising an inlet end and discharge end, said discharge end adapted to removably receive said nozzle tip, said liquid fuel pipe comprising a cylindrical member and flange portion proximate said inlet end, said cylindrical member and flange portion defining a liquid fuel flow passage extending from said inlet end and substantially downstream of said flange portion proximate said discharge end, said nozzle tip removably mounted substantially downstream of said flange portion proximate said discharge end, said flange portion further defining an atomizing air supply channel, and wherein said liquid fuel pipe and nozzle tip are removably positioned within said receptacle of said atomizing air cylinder and define an atomizing airflow passage between said tubular member and said cylindrical member of said liquid fuel pipe such that said airflow passage is in fluid communication with said atomizing air supply channel defined by said liquid fuel pipe flange portion.

2. The dual fuel nozzle in claim 1, wherein said swirl cap is welded to said atomizing cylinder.

3. The dual fuel nozzle in claim 1, wherein said atomizing cylinder receptacle is formed to concentrically receive said liquid fuel pipe.

4. The dual fuel nozzle in claim 1 wherein said atomizing cylinder receptacle comprises at least two diameters having different dimensions; and said liquid fuel pipe comprises a plurality of positioning pins downstream of said flange portion proximate said discharge end for maintaining the liquid fuel pipe positioned within said atomizing cylinder receptacle and adjacent to one of said at least two diameters such that an atomizing air flow can flow through the atomizing air flow passage defined between the said tubular member and said liquid fuel pipe.

* * * * *